US007949290B2

(12) United States Patent
Yoshikawa

(10) Patent No.: US 7,949,290 B2
(45) Date of Patent: May 24, 2011

(54) IMAGE FIXING APPARATUS AND AN IMAGE FORMATION APPARATUS INCLUDING A MAGNETIC FLUX ADJUSTER

(75) Inventor: Takahiro Yoshikawa, Kanagawa-ken (JP)

(73) Assignee: Ricoh Company, Limited, Tokyo (JP)

( * ) Notice: Subject to any disclaimer, the term of this patent is extended or adjusted under 35 U.S.C. 154(b) by 980 days.

(21) Appl. No.: 11/754,817

(22) Filed: May 29, 2007

(65) Prior Publication Data

US 2007/0274748 A1 Nov. 29, 2007

(30) Foreign Application Priority Data

May 29, 2006 (JP) ..... 2006-148589

(51) Int. Cl.
*G03G 15/20* (2006.01)

(52) U.S. Cl. ..... 399/328; 399/334; 399/69

(58) Field of Classification Search ..... 399/328, 399/329, 334, 69; 219/219, 643–645
See application file for complete search history.

(56) References Cited

U.S. PATENT DOCUMENTS

| | | | |
|---|---|---|---|
| 5,402,211 | A | 3/1995 | Yoshikawa |
| 5,850,588 | A | 12/1998 | Yoshikawa |
| 6,160,974 | A | 12/2000 | Yoshikawa et al. |
| 6,501,914 | B2 | 12/2002 | Yoshikawa |
| 6,757,502 | B2 | 6/2004 | Yoshikawa |
| 6,823,149 | B2 | 11/2004 | Yoshikawa et al. |
| 7,043,185 | B2 | 5/2006 | Yoshikawa |
| 7,127,204 | B2 | 10/2006 | Satoh et al. |
| 7,174,124 | B2 | 2/2007 | Ishibashi et al. |
| 2004/0264991 | A1 | 12/2004 | Yoshikawa |
| 2006/0013607 | A1 | 1/2006 | Yoshikawa |
| 2006/0029411 | A1 | 2/2006 | Ishii et al. |
| 2006/0171731 | A1 | 8/2006 | Yoshikawa |
| 2006/0204265 | A1 | 9/2006 | Yoshikawa |
| 2007/0014603 | A1 | 1/2007 | Satoh et al. |
| 2007/0059020 | A1 | 3/2007 | Yoshikawa |

FOREIGN PATENT DOCUMENTS

| | | | |
|---|---|---|---|
| JP | 2005-241891 | | 9/2005 |
| JP | 2005-258383 | | 9/2005 |
| JP | 2005241891 | A * | 9/2005 |
| JP | 2005-321633 | | 11/2005 |
| JP | 2006-011217 | | 1/2006 |

OTHER PUBLICATIONS

U.S. Appl. No. 12/184,710, filed Aug. 1, 2008, Yoshikawa.

* cited by examiner

*Primary Examiner* — David M Gray
*Assistant Examiner* — Laura K Roth
(74) *Attorney, Agent, or Firm* — Oblon, Spivak, McClelland, Maier & Neustadt, L.L.P.

(57) ABSTRACT

An image fixing apparatus includes a fixing member, a magnetic flux generator, a heat member, a core, and a magnetic flux adjuster. The fixing member fixes the toner image onto the recording medium. The magnetic flux generator generates a magnetic flux. The heat member has a heat layer which is heated inductively by the magnetic flux generated by the magnetic flux generator and heats the fixing member. The core faces the magnetic flux via the heat member. The magnetic flux adjuster is configured to vary a heating range of the heat member in the width direction. The heat layer has a predetermined Curie point.

19 Claims, 6 Drawing Sheets

IMAGE FIXING APPARATUS AND AN IMAGE FORMATION APPARATUS INCLUDING A MAGNETIC FLUX ADJUSTER

CROSS-REFERENCE TO RELATED APPLICATION

This patent specification is based on Japanese Patent Application No. 2006-148589 filed on May 29, 2006 in the Japan Patent Office, the entire contents of which are incorporated by reference herein.

BACKGROUND OF INVENTION

1. Field of the Invention

The present invention relates to an image forming apparatus, such as a copy machine, a printer, a facsimile machine and a multi-function machine capable of copying, printing, and faxing, and more particularly to an image fixing apparatus which uses an induction heater and is capable of stably controlling a fixing temperature 2. Description of the Background Art An image fixing apparatus using an electromagnetic-induction heating (IH) method has been known, which aims at saving energy by shortening the startup time of an image formation apparatus, such as a copying machine and a printer. For example, an improved image fixing apparatus was disclosed in Laid-open Japanese Patent Application No. 2005-258383 as Patent Reference 1. According to Patent Reference 1, for example, the image fixing apparatus of an electromagnetic-induction heating method includes a fixing belt, serving as a fixing member, that is installed with tension, and supported by a heating roller and an auxiliary fixing roller an electromagnetic-induction heating unit (IH unit) that is installed countering the heating roller with the fixing belt in-between, and a pressurizing roller that is installed countering the auxiliary fixing roller with the fixing belt in-between.

Further, the IH unit includes a coil unit and a core that is installed countering the coil unit, the coil unit being installed in the width direction (the direction that perpendicularly intersects the conveyance direction of the recording medium). Further, the heating roller includes a magnetic flux shield member which is arranged to make a heating range of the heat member variable at both ends of the core in the width direction. Here, the fixing belt is heated at a position that counters the IH unit. The heated fixing belt provides heat to a toner image on the recording medium conveyed to the position of the auxiliary fixing roller and the pressurizing roller such that the toner image is fixed. Specifically, a high frequency alternating current is provided to the coil unit, which generates a magnetic field around the coil unit, causing an eddy current to arise on the surface of the heating roller. The eddy current in the heating roller generates Joule heat due to the electric resistance of the heating roller. The Joule heat raises the temperature of the fixing belt that is installed around the heating roller. Further, the magnetic flux shield member reduces the heating range of the heat member in order to correspond the heat range to the width range of a small width recording medium after an image fixing operation is continuously performed on the small width recording medium by the image fixing apparatus.

SUMMARY OF THE INVENTION

According to an aspect of the invention, an image fixing apparatus includes a fixing member, a magnetic flux generator, a heat member, a core, and a magnetic flux adjuster. The fixing member fixes the toner image onto the recording medium. The magnetic flux generator generates a magnetic flux. The heat member has a heat layer which is heated inductively by the magnetic flux generated by the magnetic flux generator and heats the fixing member. The core faces the magnetic flux via the heat member. The magnetic flux adjuster is configured to make a heating range of the heat member variable in the width direction. The heat layer has a predetermined Curie point.

DESCRIPTION OF THE PREFERRED EMBODIMENTS

Figure 1:
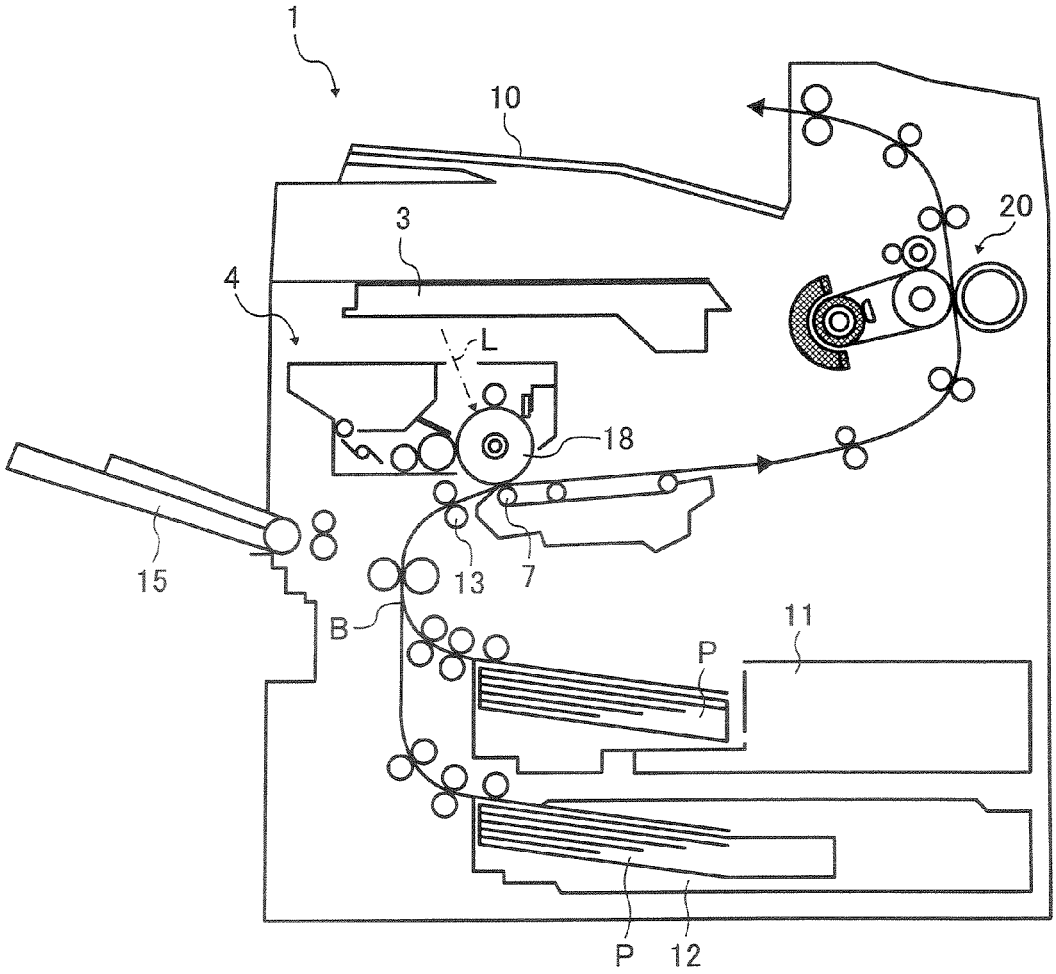
FIG. 1 is a side view of an image formation apparatus according to Embodiment 1 of the present invention.

In the following, embodiments of the present invention are described with reference to the accompanying drawings. In the following, the same reference mark is given to the same unit in the drawings, and explanations thereof are not repeated.

DETAILED DESCRIPTION OF EXEMPLARY EMBODIMENTS

Embodiment 1

Embodiment 1 of the present invention is described in detail with reference to FIGS. 1 through 5. First, the overall structure and operation of an image formation apparatus 1 according to Embodiment 1 are described. As shown in FIG. 1, the image formation apparatus 1 includes an exposure unit 3 that irradiates an exposure light L based on image information to a photo conductor drum 18, a process cartridge 4 that is detachably installed in the image formation apparatus 1, a transferring unit 7 that transfers a toner image formed on the photo conductor drum 18 to a recording medium P. a delivery tray 10 to which an output image is discharged, feed units 11 and 12 that store the recording media P. such as imprint paper, a resist roller 13 that conveys the recording medium P to the transferring unit 7, a manual feed unit 15 that feeds a recording medium P often having sizes different from the recording medium P stored by the feed units 11 and 12, and a fixing unit 20 that fixes the toner image to the recording medium P.

With reference to FIG. 1, image formation operations of the image formation apparatus are described below. First, the exposure unit 3 (write-in unit) irradiates the exposure light L, such as a laser beam, based on the image information to the surface of the photo conductor drum 18 of the process cartridge 4. The photo conductor drum 18 rotates counterclockwise (ref. FIG. 1), and a toner image corresponding to the image information is formed on the photo conductor drum 18 through predetermined imaging processes (an electrification process, an exposure process, and a development process). Then, the toner image formed on the photo conductor drum 18 is transferred to the recording medium P by the transferring unit 7, the recording medium P being conveyed by the resist roller 13. The recording medium P is conveyed to the transferring unit 7 as follows. First one of the feed units 11 and 12 is selected either manually or automatically. In the present description, it is assumed that the feed unit 11 is chosen. Here, the recording medium P stored in the feed unit 11 and the recording medium P stored in the feed unit 12 are different in sizes, or direction of placement. A recording medium P that is placed on the top in the feed unit 11 is conveyed along a conveyance route K. Then, the recording medium P arrives at the resist roller 13. There, the recording medium P waits such that the toner image formed on the photo conductor drum 1 is transferred at a proper position of the recording medium P. At the proper timing, the recording medium P is conveyed to the transferring unit 7. Then, the transferring unit 7 transfers the toner image to the recording medium P that is then conveyed to the image fixing apparatus 20. The recording medium P that reaches the image fixing apparatus 20 is inserted between the fixing belt and the pressurizing roller. There, the toner image is fixed by heat provided by the fixing belt, and pressure provided by the pressurizing roller. Then, the recording medium P to which the toner image is fixed is discharged from between the fixing belt and the pressurizing roller, and delivered to the delivery tray 10. In this way, a series of image formation processes is completed.

Figure 2:
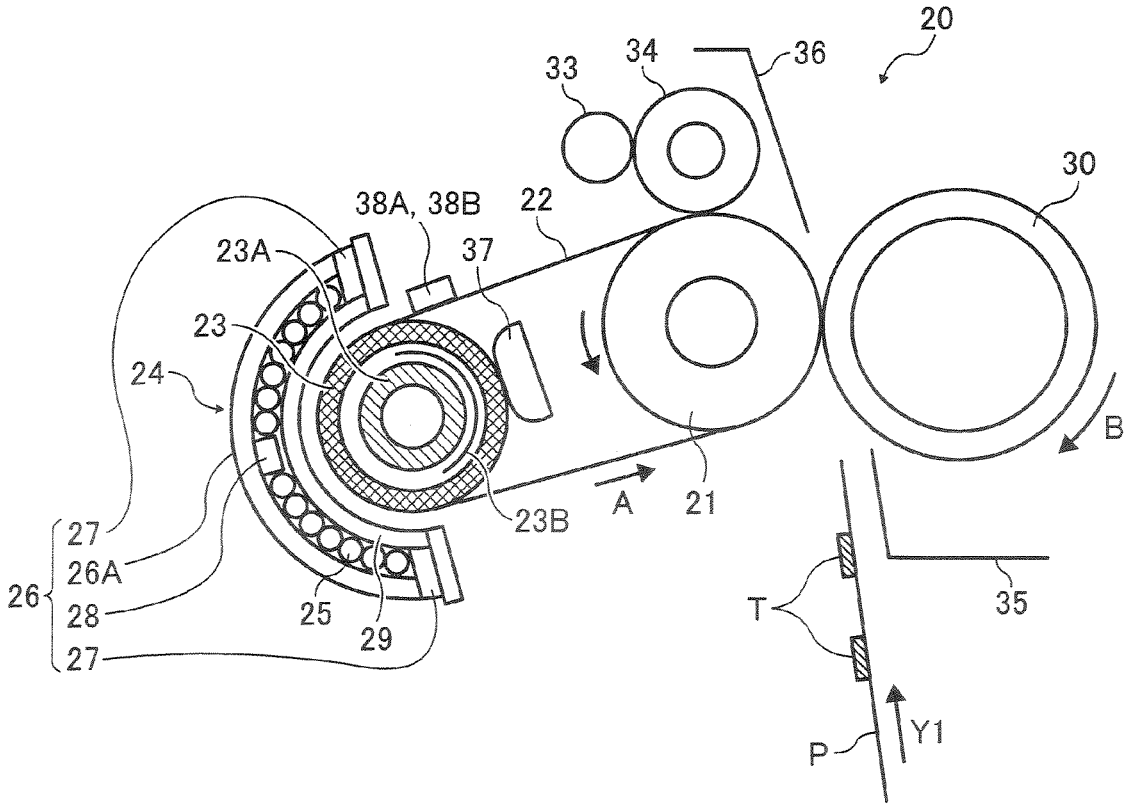
FIG. 2 is a cross-sectional drawing showing a fixing apparatus of the image formation apparatus shown in FIG. 1.

Below is the description about the structure of a image fixing apparatus 20. As shown in FIG. 2, the image fixing apparatus 20 includes an auxiliary fixing roller 21, a fixing belt 22, a heating roller 23 (heating member), an IH unit 24(magnetic flux generator), a pressurizing roller 30, a thermostat 37, a cleaning roller 33, an oil applying roller 34, a guide board 35, and a separation board 36. Here, an elastic layer of such as silicone rubber is formed on the surface of the auxiliary fixing roller 21 that is rotated counterclockwise by a drive unit (not illustrated). The heating roller 23 serving as the heating member is in the shape of a cylinder, and is rotated counterclockwise as shown in FIG. 2. The heating roller is made of the predetermined Curie point alloy only. Accordingly, the heating element of Embodiment 1 is the heating roller 23. The Curie point alloy is such as iron-nickel alloy, copper-nickel alloy, or nickel-iron-chromium alloy. The heating roller 23 includes an internal core 23A (serving as the core unit) and a shielding member 23B. The internal core 23A serving as the core unit faces a coil unit 25 with the fixing belt 22 in between. Further, the shielding member 23B is structured such that both ends of the internal core 23A in the width direction may be shielded. The internal core 23A and the shielding member 23B are rotated in one body. The rotation of the internal core 23A and the shielding member 23B is independent of the rotation of the heating roller 23 (cylinder object). The structure and operation of the heating roller 23 is described below with reference to FIGS. 3A and 3B. The fixing belt 22 serving as the fixing member is installed with tension, and supported by the heating roller 23 and the auxiliary fixing roller 21. The fixing belt 22 is an endless belt, having a multi-layer structure including a base layer of polyimide resin and a mold release layer (surface layer) of a fluorine compound, etc. The mold release layer of the fixing belt 22 provides mold release characteristics of toner T. The mold release layer is made with known a material, e.g. polytetrafluoroethylene. The IH unit 24 serving as the magnetic flux generator includes a coil unit 25, a coil guide 29, and a core unit 26 that includes an external core 26A, two side cores 27, and a center core 28. The coil unit 25 is structured with litz wires, each of which consists of thin wires, installed in the width direction (i.e., the direction perpendicular to the plane of FIG. 2). The coil unit 25 covers a part of the fixing belt 22 via the coil guide 29, the part looping along the heating roller 23. The coil guide 29 is made of a high heat-resistant resin material, for example. The coil guide 29 supports the coil unit 25 and the external core 26, the two side cores 27 and the center core 28. The external core 26, the side core 27, and the center core 28 are made of a high permeability material such as ferrite. The external core 26 is installed in the width direction facing the coil unit 25. The side cores 27 are installed at both ends of the coil unit 25. The center core 28 is installed at the center of the coil unit 25. By installing the internal core 23A in the heating roller 23, a sufficient magnetic field is formed between the external core 26 and the internal core 23A, and the heating roller 23 and the fixing belt 22 can be efficiently heated.

The pressurization roller 30 includes a metal cylinder base, and an elastic layer such as a fluororubber and silicone rubber formed on the metal cylinder base. The pressurization roller 30 pressurizes the auxiliary fixing roller 21 through the fixing belt 22. The recording medium P is conveyed between the fixing belt 22 and the pressurization roller 30, i.e., through a fixing nip. The guide board 35 is arranged on the entrance side of the fixing nip, and guides the recording medium P to the fixing nip. The separation board 36 is arranged on the exit side of the fixing nip, and helps the recording medium P separate from the fixing belt 22 while guiding the conveyance of the recording medium P. The oil application roller 34 is in contact with a part of the perimeter of the fixing belt 22. The oil application roller 34 supplies oil, such as silicone oil, to the fixing belt 22. This enhances the mold release characteristic between the toner and the fixing belt 22. In addition, a cleaning roller 33 is provided for removing dirt on the surface of the oil application roller 34. The thermostat 37 contacts a part of the perimeter of the heating roller 23. When the temperature of the heating roller 23 detected by the thermostat 37 exceeds a predetermined temperature, the thermostat 37 disconnects power supply to the IH unit 24. Further two thermistors 38A and 38B, serving as the second temperature detection unit, are installed on the fixing belt 22 such that the surface temperature of the fixing belt 22 (fixing temperature) can be directly detected for controlling the fixing temperature. The thermistor 38A is arranged approximately at longitudinal center of the fixing belt 22 and the thermistor 38B is arranged approximately at longitudinal end side of the fixing belt 22. In addition, as the temperature detection unit, a thermopile that detects the temperature of the fixing belt 22 without contact can also be used.

The image fixing apparatus 20 configured as described above operates as follows. With reference to FIGS. 2, by the rotational driving of the auxiliary fixing roller 21, the fixing belt 22 travels around in the direction of the arrow A, the cylinder of the heating roller 23 also rotates counterclockwise, and the pressurization roller 30 rotates in the direction of the arrow B. The fixing belt 22 is heated at the position opposite to the IH unit 24. In detail, a high frequency alternating current flows through the coil unit 25, which forms a magnetic field that bidirectionally alternates between the external core 26 and the internal core 23A. At this time, an eddy current arises in the surface of the heating roller 23 and Joule heat is generated by the electric resistance of the heating roller 23. The fixing belt 22 looping along the heating roller 23 is heated by this Joule heat. Then, the surface of the fixing belt 22 heated by the Joule heat reaches the fixing nip where the fixing belt 22 and the pressurization roller 30 contact, and the toner image T formed by the imaging process as described above on the conveyed recording medium P is heated and fused. In more detail, the recording medium P that supports the toner image T is guided by the guide board 35, and is fed to the fixing nip as arrow Y1 that indicates the conveyance direction. Then, the toner image T is fixed to the recording medium P by the heat from the fixing belt 22 and the pressure from the pressurization roller 30, and the recording medium P is discharged from the fixing nip.

Figure 3A:
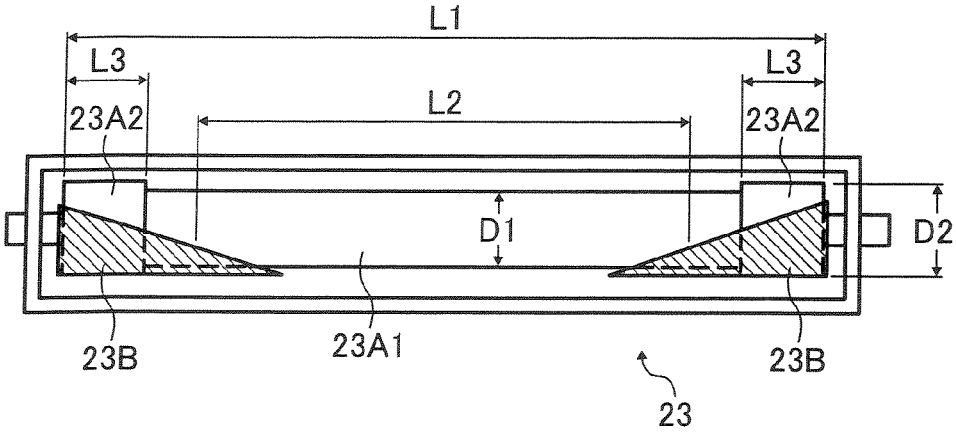
FIGS. 3A and 3B give cross-sectional drawings showing heating rollers installed in the fixing apparatus shown in FIG. 2.
Figure 3B:
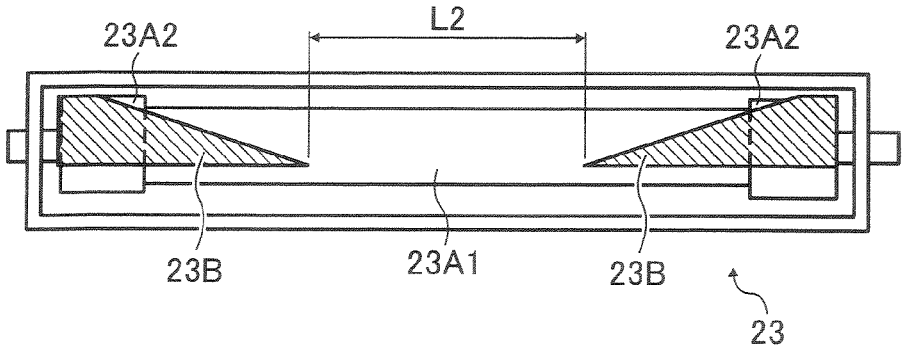

Below is the description about the structure and operation of the heating roller 23 of the Embodiment 1. FIG. 3A and FIG. 3B shows front views of the heating roller 23 of the image fixing apparatus 20 shown by FIG. 2 in the width direction viewed from the IH unit 24 side. In FIG. 3B, a state is shown wherein the internal core 23A (constituted by a small diameter section 23A1 and two large diameter sections 23A2) and the shielding members 23B are rotated by a predetermined angle from a state shown at FIG. 3A. As shown in FIG. 3A, the internal core 23A in the shape of a solid cylinder having a width L1, and the shielding members 23B are rotatably installed in the hollow cylinder of the heating roller 23. The internal core 23A serving as the core unit includes the small diameter section 23A1 provided in the central part in the width direction, and the large diameter sections 23A2 provided at both ends in the width direction. The width of each large diameter section 23A2 is L3. The large diameter sections 23A2 are formed so that a diameter D2 of the large diameter sections 23A2 may be greater than a diameter D1 of the small diameter section 23A1. In addition, the form of the internal core 23A is not limited to the shape of a solid cylinder, but can also be made into the shape of a hollow cylinder. At both ends of the internal core 23A in the width direction, the shielding member 23B is installed. The shielding members 23B are formed so that a range of the internal core 23A that is to be shielded can be gradually increased from the edges (ends) of the internal core 23A, or decreased. By rotating the internal core 23A and the shielding members 23B, the shielded range is adjusted in the width direction of the internal core 23A that counters the coil unit 25 of the IH unit 24. Here, the rotation of the internal core 23A and the shielding members 23B is driven by a stepping motor (not illustrated) connected to the axle of the internal core 23A. This stepping motor is different from a drive motor (not illustrated) for driving the auxiliary fixing roller 21, the fixing belt 22, and the heating roller 23. Specifically, when the internal core 23A (23A1 and 23A2) and the shielding members 23B in the state as shown in FIG. 3A are rotated by 90° about the axis in the direction of the circumference, the internal core 23B and the shielding members 23B come to the state as shown in FIG. 3B. At this time, the maximum range of the internal coil 23A that counters the IH unit 24 is shielded. The lines of magnetic flux that are to be formed between the internal core 23A and the core 26 of the IH unit 24 are intercepted at the range shielded by the shielding members 23B. Therefore, a part of the fixing belt 22 corresponding to the shielded range is not fully heated, but only an un-shielded range serves as the heated range of the fixing belt 22, the un-shielded range being the central area indicated by L2. This state is suitable for continuously fixing recording media P of width L2.

Specifically, when recording media P of a predetermined minimum width of an image formation apparatus, for example, 148 mm, the internal core 23A and the shielding members 23A are put in the position as shown in FIG. 3B, and the fixing process described with reference to FIG. 2 is performed. At this time, the fixing temperature distribution in the width direction on the fixing belt 22 is made even throughout the range of the width L2 as shown in FIG. 3A. Accordingly, satisfactory fixing to the recording medium P of the width L2 is obtained. Further, in the ranges beyond the width L2 of the fixing belt 22, the temperature does not rise, and thermal breakage of the fixing belt 22 can be prevented from occurring. When the internal core 23A and the shielding members 23B are further rotated by 180° in the direction of the circumference from the state shown in FIG. 3B, the shielded range is minimized, and the heating range is maximized. That is, the width L1 is fully heated. This state is suitable for continuously fixing the recording media P having the width L1. Specifically, when the recording media P having the maximum width, for example, 297 mm, are continuously fixed, the internal core 23A and the shielding members 23B are rotated by 180° from the state shown in FIG. 3B, and the fixing process described above with reference to FIG. 2 is performed. At this time, the fixing temperature distribution in the width direction on the fixing belt 22 is made even throughout the range of the width L1, without depression of the fixing temperature at both ends in the width direction as shown by the solid line R1 of FIG. 4. Accordingly, satisfactory fixing is obtained to the recording medium P having the width L1. The results described above are attributed to the fact that the large diameter section 23A2 is formed at both ends in the width direction of the internal core 23A, the curve in the solid line R1 being compared with the curve S in FIG. 4. The large diameter section 23A2 functions as the projecting section that projects toward the coil unit 25 as compared with the small diameter section 23A1 in the state of maximizing the heated range of the fixing belt 22. According to the structure of the heating roller 23 described above, an amount of heat at longitudinal end side of the heating roller 23 becomes higher than an amount of heat at longitudinal center thereof when the shielding member 23B is out of operation, i.e. the surface of the internal core 23A opposite to the IH unit 24 is revealed without shielding of the shielding member 23B. The distribution of amount of heat on the surface of internal core 23A described above prevents the fixing temperature of the fixing belt 22 at the beginning of the fixing operation from becoming uneven in the width direction. That is, in the case that the large diameter sections 23A2 are not formed, when the image fixing apparatus is out of operation, e.g. an idling that the IH unit 24 heats the heating roller 23 with stopping the fixing belt 22 driving, the temperature at both ends of the fixing belt 22 in the width direction falls down lower than the temperature at the center of the fixing member in the width direction. It is because the both ends of the heating roller in the width direction diffuse heat. As a result, the image fixing apparatus may output a damaged image on the recording medium whose image density is uneven in the width direction at the beginning of the fixing operation. In contrast, in the case that the large diameter section 23A2 is formed at each end, the distance between the large diameter sections 23A2 and the coil unit 25 becomes small, and the flux density formed there becomes greater than the one formed at each end of the internal core which does not have the large diameter section 23A2 at each end. Accordingly, the diffusion of the heat from both ends of the fixing belt 22 is compensated with the greater flux density, and the fixing temperature at the both ends of the heating roller 23 in the width direction is prevented from dropping extremely. As a result, the temperature range of the fixing belt 22 opposite to the heating roller 23 becomes substantially even.

Below is the description about a degauss characteristic and an effect of the predetermined Curie point alloy. When the temperature of the heating roller 23 is lower than its Curie point, the Curie point alloy with which the heating roller 23 is made keeps its ferromagnetic characteristic. A magnetic flux generated by the IH unit 24 concentrates to the heating roller 23 and heats it up sufficiently by the electromagnetic-induction. Meanwhile, when the temperature of the heating roller 23 surpasses its Curie point, the Curie point alloy with which the heating roller 23 is made loses its ferromagnetic characteristic. A magnetic flux generated by the IH unit 24 goes through the heating roller 23 and heats it insufficiently by the electromagnetic-induction. As a result, the heating roller 23A and the fixing belt 22 are effectively heated by the IH unit 24, and a degauss characteristic which the predetermined Curie point alloy has prevents them from being heated up too much by electromagnetic-induction of the IH unit 24. In Embodiment 1, the Curie point of the heating roller 23 is predetermined approximately at 220° C. A desired Curie point can be obtained by adjusting an amount of each material which forms the Curie point alloy and adjusting the process of forming it.

As described above, Embodiment 1 is structured such that the heating roller 23 is made with the predetermined Curie point alloy, the internal core 23A is arranged opposed to the IH unit 24 via the heating roller 23, and the heating roller 23 includes the shield member 23B which makes the heating range of the heating roller 23 variable at both ends of the internal core 23A in the width direction. And the image fixing apparatus of Embodiment 1 makes the standup time of the image fixing apparatus shorten to continue to provide the current to the 1H unit 24 even when the image fixing apparatus is out of operation with preventing the fixing belt 22 from causing the thermal breakdown.

Figure 4:
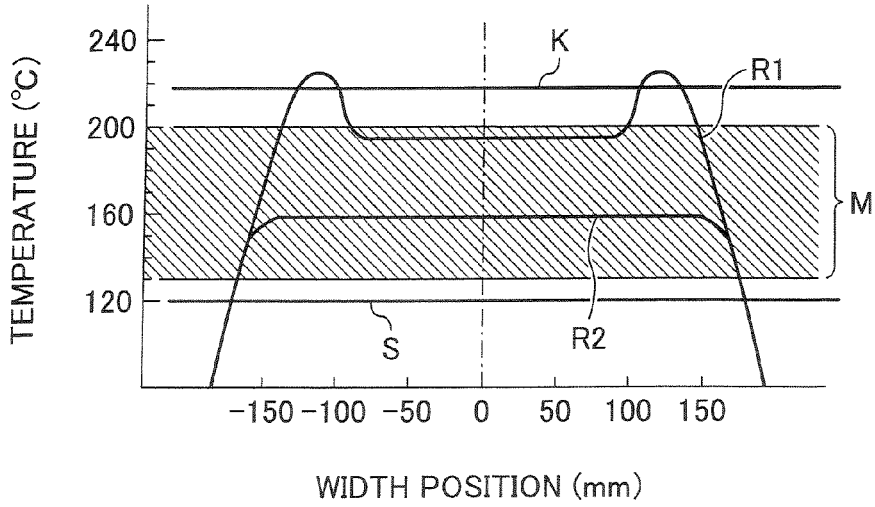
FIG. 4 is a graph showing the relationship among the predetermined fixing temperature range, the Curie point K of the heating roller 23, the temperature boundary S at which the shield member 23B starts to shield the heating range, and the temperature distribution R1 and R2 in the width directions of a fixing belt of the fixing apparatus shown by FIG. 2.
Figure 5:
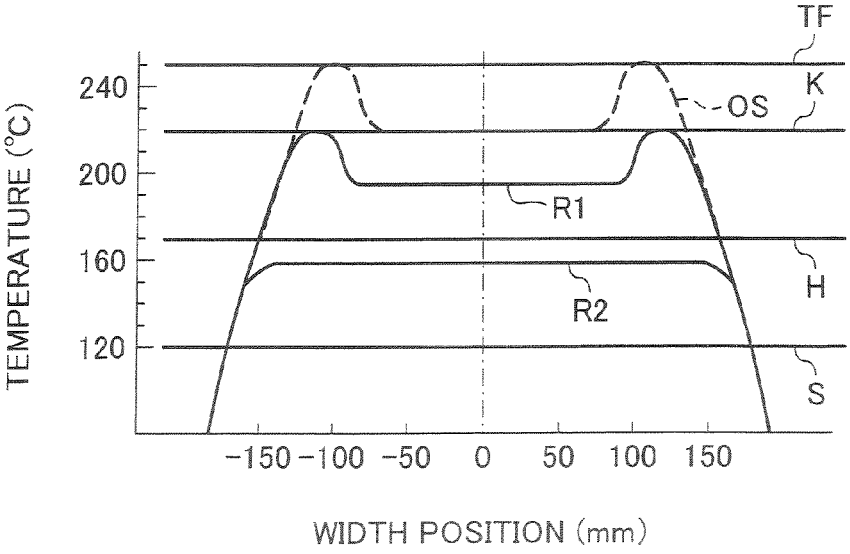
FIG. 5 is a graph showing the relationship among a melting temperature boundary TF of the release layer of the fixing belt 22, the temperature distribution OS when the temperature rises up to excess at both ends of the surface of the heating roller 23, the Curie point K of the heating roller 23, the temperature boundary S at which the shield member 23B starts to shield the heating range, and the temperature distribution F1 and R2 in the width directions of a fixing belt of the fixing apparatus shown by FIG. 2.

Below is the description about another function and effect of Embodiment 1 with reference of FIG. 4 and FIG. 5. FIGS. 4 and 5 are graphs each of which shows the temperature distribution in the width directions on the heating roller 23. In each of those graphs, the horizontal axis shows the position in the width directions of the heating roller 23, the vertical axis shows the temperature (fixing temperature) of the surface of the fixing belt 22, and the position indicated by 0 in the horizontal axis represents the center of the heating roller 23 in the width direction. In FIG. 4, a curve R1 shows the temperature distribution when the temperature rises up to excess at both ends of the surface of the heating roller 23. A curve R2 shows the temperature distribution when the heated range of the heating roller 23 becomes even. Further, a hatched area M shows a predetermined fixing temperature range within which the temperature of the surface of the fixing belt 22 is controlled. As shown in FIG. 4 and FIG. 5, the Curie point of the heating roller 23 which is a part of Embodiment 1 is set higher than a predetermined upper limit value in fixing temperature range within which the image fixing apparatus fixes the toner image onto the recording medium and lower than a melting temperature of a material with which the release layer is made. The material is polytetrafluoroethylene.

As shown in FIG. 4, the Curie point of the heating roller 23, which is shown with a horizontal line K, is set higher than a predetermined upper limit value of the fixing temperature range which is a upper boundary of the area M corresponding to 200° C. Because of the setting of the Curie point, when the fixing temperature is controlled within the area M, the heating roller 23 which is made with the Curie point alloy keeps its ferromagnetic characteristic. As a result, a magnetic flux generated by the IH unit 24 concentrates to the heating roller 23A and heats up it sufficiently by the electromagnetic-induction.

In FIG. 5, the horizontal line TF shows a melting temperature boundary of the release layer of the fixing belt 22, above which the release layer starts to melt. A curve OS shows the temperature distribution when the temperature rises up to excess at both ends of the surface of the heating roller 23. The horizontal line H shows a hot off-set temperature boundary of the fixing belt 22 above which a hot off-set occurs at the end of a heating member of an another fixing unit in the width direction which does not equip the shield member 23B. The hot off-set temperature boundary of the fixing belt 22 is determined to experiment at what fixing temperature there occurs the hot off-set on broader width recording mediums which are passed through the another fixing unit after an image fixing operation is consecutively performed on a small width recording medium by the another fixing unit. In order to analyze the hot off-set temperature more effectively, it is preferable the broader width recording medium is widest and thinnest in all kinds of mediums which the image forming apparatus in FIG. 1 can convey. The Curie point of the heating roller 23, which is shown with a horizontal line K in FIG. 5, is set lower than the melting temperature boundary TF. Because of the setting of the Curie point, if the temperature at both ends of the surface of the heating roller 23 surpasses the horizontal line K when the image fixing apparatus is out of operation, the heating roller 23, which is made with the Curie point alloy, loses its ferromagnetic characteristic. Accordingly, the magnetic flux generated by the IH unit 24 goes through the heating roller 23, and the temperature of the heating roller 23 does not reach the melting temperature boundary TF. As a result, the IH unit 24 heats the heating roller 23 with the fixing belt 22 prevented from suffering a thermal breakdown.

Moreover, when the temperature at the end of the surface of the fixing belt 22 in the width direction which is detected by the thermistor 38B reaches the hot off-set temperature boundary H, the shield member 23B starts to shield the heating range of the heating roller 23 at both ends in the width direction. In particular, when the temperature at the end of the surface of the fixing belt 22 in the width direction reaches a solid line S, shown in FIGS. 4 and 5, which is 120° C, the shield member 23B starts to shield the heating range. As a result, the shield member 23B prevents the temperature at both ends of the surface of the fixing belt 22 in the width direction at the beginning of the fixing operation from dropping. The shield member 23B also prevents the temperature at both ends of the surface of the fixing belt 22 from rising up to excess after an image fixing operation is consecutively performed on a small width recording medium. Because of the shield member 23B described above, the hot off-set is prevented from occurring at both ends of the surface of the fixing belt 22.

With reference to FIG. 4, the temperature boundary of the fixing belt 22 as the solid line S, at which the shield member 23b starts to shield the surface of the heating roller 23, is set lower than a predetermined upper limit value of the fixing temperature range which is a lower boundary of the area M corresponding to 140° C. Because of this setting, the image fixing apparatus of Embodiment 1 does the ordinal fixing operation without the hot off-set occurring at both ends of the fixing belt 22.

Embodiment 2

Figure 6:
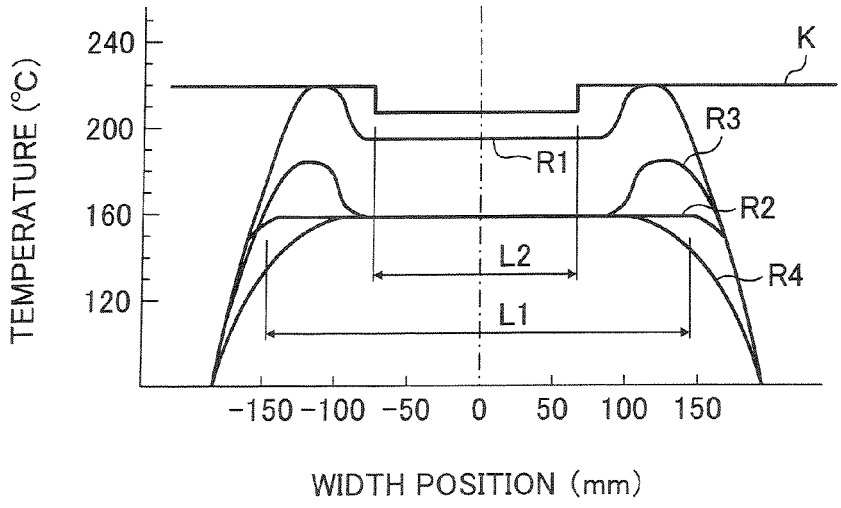
FIG. 6 is a graph showing the relationship among the Curie point K (Embodiment 2) of the heating roller 23 which is shown as a step line, and the temperature distribution R1, R2, R3, and R4 in the width directions of a fixing belt of the fixing apparatus shown by FIG. 2.
Figure 7:
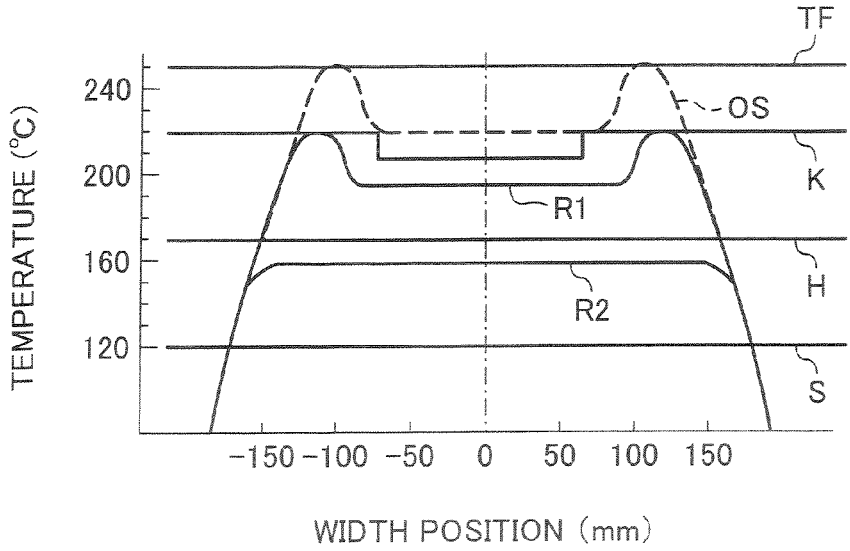
FIG. 7 is a graph showing the relationship among the Curie point K (Embodiment 2) of the heating roller 23 which is shown as a step line, a melting temperature boundary TF of the release layer of the fixing belt 22, the temperature distribution OS when the temperature rises up to excess at both ends of the surface of the heating roller 23 the temperature boundary S at which the shield member 23B starts to shield the heating range, and the temperature distribution R1 and R2 in the width directions of a fixing belt of the fixing apparatus shown by FIG. 2.

Embodiment 2 is a derivative form from Embodiment 1. An image fixing apparatus of Embodiment 2 has the same mechanical structure as the one of Embodiment 1 except the arrangement of the Curie point of the heating roller 23 in the width direction. The image fixing apparatus of Embodiment 2 adopts a preferable setting that the end and the center of the heating roller 23 in the width direction have different Curie points respectively and the Curie point at the end of the heating roller 23 becomes higher than the Curie point at the center of it. This setting is shown in FIG. 6 and FIG. 7 as the temperature distribution of the heating roller 23. FIG. 6 and FIG. 7 are graphs each of which shows the temperature distribution in the width directions on the heating roller 23. In each of those graphs, the horizontal axis shows the position in the width directions of the heating roller 23, the vertical axis shows the temperature (fixing temperature) of the surface of the fixing belt 22, and the position indicated by 0 in the horizontal axis represents the center of the heating roller 23 in the width direction. In FIGS. 6 and 7, the Curie point of the heating roller 23 is shown as a step line K. A horizontal range L2 in the step line K, which corresponds to the center of the heating roller 23 in the width direction, is the predetermined Curie point of the center of the heating roller 23, which is abbreviated to the center Curie point. A horizontal range (L1 minus L2) in the step line K, which corresponds to the both ends of the heating roller 23 in the width direction, is the predetermined Curie point of the both ends of the heating roller 23, which is abbreviated to the end Curie point. A curve R1 in FIGS. 6 and 7, as in FIG. 4, shows the temperature distribution when the temperature rises up to excess at both ends of the surface of the heating roller 23. A curve R2 in FIGS. 6 and 7, as in FIG. 4, shows the temperature distribution when the heated range of the heating roller 23 becomes even. A curve R3 in FIGS. 6 and 7 is the temperature distribution in the width direction on the heating roller 23 after an image fixing operation is consecutively performed on a small width recording medium. A curve R4 in FIGS. 6 and 7 is the temperature distribution of the auxiliary fixing roller 21 which is substantially identified with the pressurizing roller 30 when the image fixing apparatus is out of the fixing operation. FIG. 7 is a graph which shows the relationship among the Curie point of the heating roller 23 shown as a step line K in FIG. 6, the boundary S, the hot off-set temperature boundary H, and the melting temperature boundary TF of the release layer. FIG. 6 and FIG. 7 show the predetermined relationship between the Curie point and the temperature distribution in the width direction on the heating roller 23 in which the center Curie point corresponds to the center a low part of the temperature distribution of the heating roller 23 and the end Curie point corresponds to high part of the temperature distribution of the heating roller 23. Because of the predetermined relationship, the entire heat range of the heating roller 23 is well-balanced.

Embodiment 3

Figure 8:
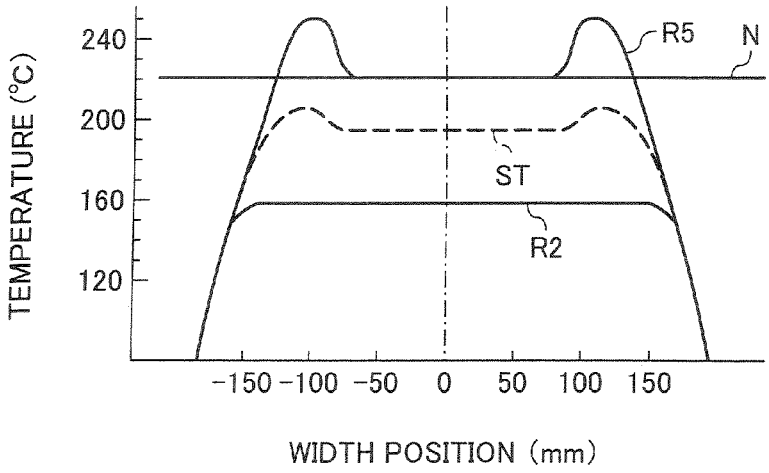
FIG. 8 is a graph showing the relationship among an expected temperature boundary N of the fixing belt 22 when the temperature of the surface of the heating roller 23 rises up over the predetermined Curie point K, and the temperature distribution ST of fixing belt 22, which is still lower than the expected temperature boundary N.

Embodiment 3 is a derivative form from Embodiment 1. A image fixing apparatus of Embodiment 2 has the same mechanical structure as the one of Embodiment 1 except the operation based on the temperature detection results of the fixing belt 22 and the heating roller 23. FIG. 8 is a graph that shows a situation that the temperature of the heating roller 23 rises up over the Curie point in order to explain a preferable programmed sequence in Embodiment 3. A curve R2 in FIG. 8, as in FIG. 4, shows the temperature distribution when the heated range of the heating roller 23 becomes even. A curve R5 in FIG. 8 shows a temperature distribution of the surface of the heating roller 23 rises up over the predetermined Curie point K. The solid horizontal line K in FIG. 4 and the solid step line K in FIG. 6 are omitted in FIG. 8. A horizontal line N is an expected temperature boundary of the fixing belt 22 when the temperature of the surface of the heating roller 23 rises up over the predetermined Curie point K. A curve ST shows the temperature of the fixing belt 22. It is a preferable programmed sequence for fixing operation in Embodiment 3 that the image fixing apparatus gets out of operation with the IH unit 24 out of generating the magnetic flux operation when the first detector, which is explained in detail later, detects that the temperature distribution of the surface of the heating roller 23 shown as R5, raises up over the predetermined Curie point, and the thermistor 38A or 38B (the second detector) detects the temperature of fixing belt 22, shown as a curve ST, which is still lower than a expected temperature shown as a curve in a solid line N. Despite the high temperature of the heating roller 23, the temperature of the fixing belt 22 is detected still low by the thermistor 38A or 38B such that the thermistor 38A or 38B may be in trouble. The sequence described above the image fixing apparatus predicts trouble of the thermistor 38A or 38B and prevents poor fixing operation. It is also an another preferable programmed sequence for fixing operation in Embodiment 1 or Embodiment 2 that the fixing still operates with the IH unit 24 out of generating the magnetic flux operation when the first detector, which is explained in detail later, detects the temperature distribution shown as R5 raises up over the predetermined Curie point, and the thermistor 38A or 38B detects that the temperature of fixing belt 22 is also higher than an expected temperature shown as a curve in a solid line N. The operation of the fixing apparatus intends the driving of the fixing belt 22, auxiliary fixing roller 21, heating roller 23, and pressurizing roller 30 without providing the current to the IH unit. The sequence described above conveys heat from the fixing belt 22 and the heating roller 23 to the auxiliary fixing roller 21 and the pressurizing roller 30. As a result, the temperature distribution of the heating roller 23 becomes even like R2. The situation, that the temperature distribution of the surface of the heating roller 23 raises up over the predetermined Curie point, stops the IH unit 24 from causing the eddy current to arise on the surface of the heating roller 23. The image fixing apparatuses of Embodiment 1 and 2 can adopt a circuit detecting a shift of output of an inverter power pack, which provides the current to the IH unit 25, as the first detector.

The heating rollers of Embodiment 1, 2 and 3 only serve as the heat member. Moreover, both the heating roller 23 and fixing belt may serve as the heat member, and only the fixing belt may serve as the heat member in all of those embodiments. Moreover the fixing belt may be formed to have a heat layer between the base layer and the mold release layer in all of those embodiments.

Embodiment 4

Figure 9:
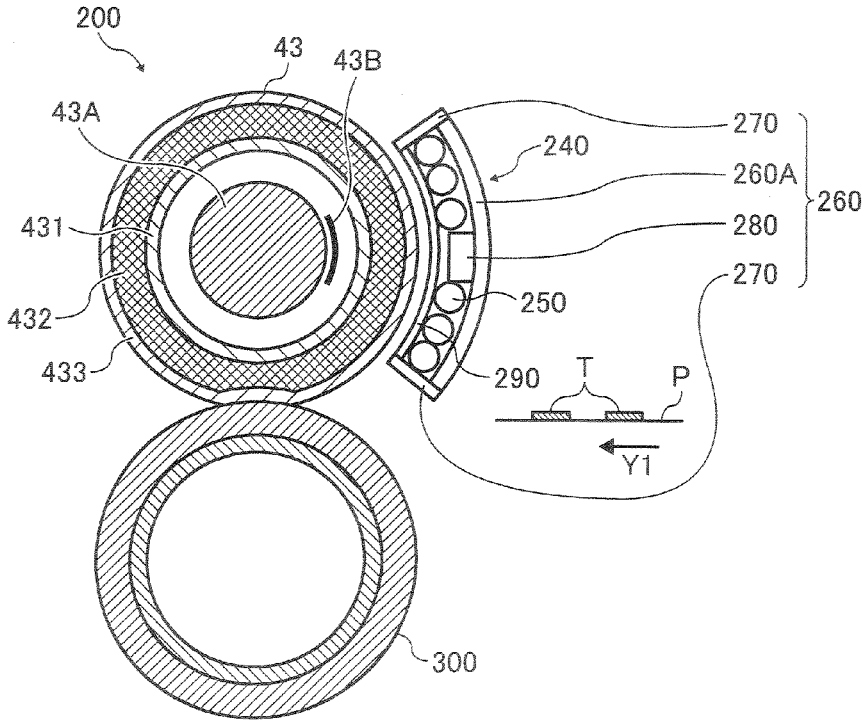
FIG. 9 is a cross-sectional drawing showing a fixing apparatus of the image formation apparatus of Embodiment 3.

Embodiment 4 of the present invention is described in detail with reference to FIG. 9. FIG. 9 shows the cross section of an image fixing apparatus of Embodiment 4. The image fixing apparatus of Embodiment 4 has a fixing roller 43, which is different from the fixing belt of Embodiments 1, 2 and 3, serves as the fixing member. As shown in FIG. 9, the image fixing apparatus 200 includes a fixing roller 43, a pressurizing roller 300, an IH unit 240 (magnetic flux generator), an internal core 43A, and a shield member 43B. The fixing roller 43 serves concurrently as the fixing member and heating member has a multi-layer structure including a metal cylinder object 431, and an elastic layer 432, a heat layer 433, and a release layer (not illustrated) formed on the metal cylinder object. The heat layer 433 is made with a predetermined Curie point alloy as the heating roller 23 of Embodiment 1. The internal core 43A faces the IH unit 240 with the fixing roller 43 in between. Further, the shielding member 433 is structured such that both ends of the internal core 43A in the width direction may be shielded. The internal core 43A and the shielding member 43B are rotated in one body. The rotation of the internal core 43A and the shielding member 43B is independent of the rotation of the fixing roller 43 (cylinder object). The IH unit 240 serving as the magnetic flux generator includes a coil unit 250, a coil guide 290, and a core unit 260 that includes an external core 260A, two side cores 270, and a center core 280. The coil unit 250 is structured with litz wires, each of which consists of thin wires installed in the width direction (i.e. the direction perpendicular to the plane of FIG. 9), and the coil unit 250 covers a part of the fixing roller 43 via the coil guide 290. The coil guide 290 is made of a high heat-resistant resin material, etc., and supports the coil unit 250 and the external core 260A, the side core 270 and the center core 280. The external core 260A, the side core 270, and the center core 280 are made of a high permeability material such as ferrite. The external core 260A is installed in the width direction facing the coil unit 250. The side cores 270 are installed at both end of the coil unit 250. The center core 280 is installed at the center of the coil unit 250. By installing the internal core 43A in the fixing roller 43 sufficient magnetic field is formed between the external core 260A and the internal core 43A, and the heating layer 433 of the fixing roller 43 can be efficiently heated. Even when the fixing roller 43 and the pressurizing roller 300 stop driving, the IH unit 240 still heats up the fixing roller 43 and makes the startup time of the image fixing apparatus shorter.

The image fixing apparatus 200 configured as described above operates as follows. The pressurizing roller 300 is rotated counterclockwise with depending on the counterclockwise rotation of the fixing roller 43. The fixing roller 43 is heated at the position opposite to the IH unit 240. In detail, a high frequency alternating current flows through the coil unit 250, which forms a magnetic field that bidirectionally alternates between the external core 260A and the internal core 43A. At this time, an eddy current arises in the surface of the heat layer 433 and Joule heat is generated by the electric resistance of the heat layer 433. The fixing roller 43 is heated by this Joule heat. Then, the surface of the fixing roller 43 heated by the Joule heat reaches the fixing nip where the fixing roller 43 and the pressurization roller 300 contact, and the toner image T formed by the imaging process as described above on the conveyed recording medium P is heated and fused. As described above, Embodiment 4 is structured such that the heat layer 433 of the fixing roller 43 is made with the predetermined Curie point alloy, the internal core 43A is arranged opposed to the IH unit 240 via the fixing roller 43, and the fixing roller 43 includes the shield member 43B, which makes the heating range of the fixing roller 43 variable, at both ends of the internal core 43A in the width direction. The image fixing apparatus of Embodiment 4 makes the startup time of the image fixing apparatus shorter by continuing to provide the current to the IH unit 240 even when the image fixing apparatus is out of operation, and thus preventing the fixing roller 43 from malfunctioning.

In addition, it is evident that the present invention is neither limited to Embodiments described above nor limited to what is suggested by Embodiments. Variations and modifications may be made without departing from the scope of the present invention. Further, the quantity, the position, the form, the shape, and the like of the components described above are not limited to what are described, but the present invention can be applied to an implementation that uses a quantity, position, form, shape, and the like different from the described Embodiments.

What is claimed is:

1. An image fixing apparatus comprising:

a fixing member configured to fix a toner image onto a recording medium;

a magnetic flux generator configured to generate a magnetic flux;

a heat member including a heat layer which is heated inductively by the magnetic flux generated by the magnetic flux generator, the heat member configured to heat the fixing member; and a core configured to receive the magnetic flux via the heat member; and a magnetic flux adjuster configured to vary a heating range of the heat member in a width direction, wherein the heat layer has a predetermined Curie point, an end and a center of the heat layer in the width direction have different Curie points respectively, and the Curie point at the end of the heat layer is higher than the Curie point at the center thereof.

2. The image fixing apparatus according to claim 1, wherein the magnetic flux adjuster is configured to vary the heating range of the heat member in the width direction by shielding a part of the core in the width direction.

3. The image fixing apparatus according to claim 2, wherein the predetermined Curie point is higher than a predetermined upper limit value in fixing temperature range within which the image fixing apparatus fixes the toner image onto the recording medium.

4. The image fixing apparatus according to claim 3, wherein the fixing member has a release layer which makes the recording medium easily released therefrom, and the predetermined Curie point is lower than a melting temperature of the release layer.

5. The image fixing apparatus according to claim 4, wherein the magnetic flux adjuster is configured to decrease the heating range of the heat member at an end of an outer circumferential surface of the heat member in the width direction when the fixing temperature reaches a predetermined value at which a hot off-set occurs at the end of the heat member of an another fixing apparatus which does not include the magnetic flux adjuster.

6. The image fixing apparatus according to claim 5, wherein the magnetic flux adjuster is configured to decrease the heating range of the heat member at an end of an outer circumferential surface of the heat member in the width direction when the fixing temperature reaches the predetermined value determined by experiment at what fixing temperature there occurs the hot off-set on broader width recording mediums, which are passed through the another fixing apparatus after an image fixing operation is consecutively performed on a smaller width recording medium by the another fixing apparatus.

7. The image fixing apparatus according to claim 6, wherein the magnetic flux adjuster is configured to increase the heating range of the heat member at the end of the outer circumferential surface of the heat member in the width direction, when the fixing temperature reaches a predetermined value which is set lower than a predetermined lower limit value in the fixing temperature range.

8. The image fixing apparatus according to claim 1, wherein the heat member is configured such that an amount of heat at the end of the heat member in the width direction becomes higher than an amount of heat at the center thereof in the width direction, when the magnetic flux adjuster is out of operation.

9. The image fixing apparatus according to claim 1, wherein the magnetic flux adjuster is configured to decrease the heating range of the heat member at an end of an outer circumferential surface of the heat member in the width direction, wherein the end of the outer circumferential surface of the heat member in the width direction corresponds to the end of the heat layer in the width direction.

10. The image fixing apparatus according to claim 1, wherein a distance between a width end of a core and a heat member part opposite to the width end of the core is shorter than a distance between a center of the core and the heat member part opposite to the center of the core.

11. The image fixing apparatus according to claim 1, wherein the magnetic flux generator is configured to generate magnetic flux even when the image fixing apparatus is out of operation.

12. The image fixing apparatus according to claim 11, further comprising:

a first detector configured to detect a situation when a temperature of the heat layer raises up over the predetermined Curie point;

a second detector configured to detect a temperature of the fixing member; wherein the image fixing apparatus is configured to end operation with the magnetic flux generator not generating the magnetic flux when the first detector detects the situation and the second detector detects a temperature of fixing member which is lower than a predetermined temperature thereof, and the image fixing apparatus is configured to operate with the magnetic flux generator not generating the magnetic flux when the first detector detects the situation and the second detector detects a temperature of fixing member which is larger than a predetermined temperature thereof.

13. The image fixing apparatus according to claim 1, further comprising:

a plurality of rollers, wherein the heat member is a heating roller which is one of the plurality of rollers, and the fixing member is a fixing belt installed with tension and supported by the plurality of rollers; and a pressure roller configured to contact with the fixing belt and to press the recording medium in conveyance toward the fixing belt, wherein the core is an internal core of the heating roller.

14. The image fixing apparatus according to claim 1, wherein the heat member is part of the fixing member.

15. The image fixing apparatus according to claim 14, further comprising:

a plurality of rollers, wherein the fixing member is a fixing belt installed with tension and supported by the plurality of rollers; and a pressure roller configured to contact with the fixing belt and press the recording medium in conveyance toward the fixing belt, wherein the core is an internal core of at least one of the plurality of rollers.

16. The image fixing apparatus according to claim 14, further comprising:

a pressure roller configured to contact with the fixing member, wherein the fixing member is a fixing roller which fixes the toner image onto the recording medium, and the pressure roller presses the recording medium during conveyance toward the fixing roller.

17. An image forming apparatus comprising:

an image carrier configured to carry a toner image;

a transfer apparatus configured to transfer the toner image from said image carrier to a surface of a recording medium; and an image fixing apparatus configured to fix the toner image onto the recording medium conveyed from the transfer apparatus, the image fixing apparatus including, a fixing member configured to fix the toner image onto the recording medium;

a magnetic flux generator configured to generate a magnetic flux;

a heat member including a heat layer which is heated inductively by the magnetic flux generated by the magnetic flux generator and configured to heat the fixing member;

a core configured to receive the magnetic flux via the heat member; and a magnetic flux adjuster configured to vary a heating range of the heat member in a width direction, wherein the heat layer has a predetermined Curie point, an end and a center of the heat layer in the width direction have different Curie points respectively, and the Curie point at the end of the heat layer is higher than the Curie point at the center thereof.

18. The image forming apparatus according to claim 17, wherein the magnetic flux adjuster is configured to vary the heating range of the heat member in the width direction by shielding a part of the core in the width direction.

19. An image forming apparatus comprising:

an image carrier configured to carry a toner image;

a transfer apparatus configured to transfer the toner image from the image carrier to a surface of a recording medium; and an image fixing apparatus configured to fix the toner image onto the recording medium conveyed from the transfer apparatus, the image fixing apparatus including, means for fixing the toner image onto the recording medium;

means for generating a magnetic flux; and means for heating the means for fixing the toner image onto the recording medium, which has a heat layer which is heated inductively by the magnetic flux and heats the means for fixing;

a core configured to receive the magnetic flux via the means for heating; and means for varying a heating range of the means for heating in a width direction, wherein the heat layer has a predetermined Curie point, an end and a center of the heat layer in the width direction have different Curie points respectively, and the Curie point at the end of the heat layer is higher than the Curie point at the center thereof.

* * * * *